US008296019B2

(12) United States Patent
Kendrick

(10) Patent No.: US 8,296,019 B2
(45) Date of Patent: Oct. 23, 2012

(54) AUTOLOAD SYSTEM FOR EXCAVATION BASED ON PRODUCTIVITY

(75) Inventor: Larry Ellis Kendrick, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 1329 days.

(21) Appl. No.: 11/902,750

(22) Filed: Sep. 25, 2007

(65) Prior Publication Data

US 2009/0082929 A1 Mar. 26, 2009

(51) Int. Cl.
*G06F 19/00* (2011.01)

(52) U.S. Cl. ..... 701/50; 701/82; 700/275; 172/2; 172/4; 172/4.5; 172/7; 172/9; 56/13.9; 56/192; 425/197; 384/540

(58) Field of Classification Search ..... 701/50, 701/82; 156/184; 493/446; 414/729; 483/55; 425/197; 384/540; 700/275; 172/2, 4, 4.5, 172/7, 9, 79; 56/13.9, 192
See application file for complete search history.

(56) References Cited

U.S. PATENT DOCUMENTS

| | | | | | |
|---|---|---|---|---|---|
| 3,497,014 | A | | 2/1970 | Ask | |
| 3,720,122 | A | * | 3/1973 | Mendoza | 82/137 |
| 3,957,121 | A | | 5/1976 | Takeda | |
| 4,053,018 | A | | 10/1977 | Takeda | |
| 4,194,574 | A | | 3/1980 | Benson et al. | |
| 4,282,933 | A | | 8/1981 | Suganami et al. | |
| 4,423,785 | A | | 1/1984 | Kurihara et al. | |
| 4,907,653 | A | | 3/1990 | Bellanger et al. | |
| 4,918,608 | A | | 4/1990 | Middleton et al. | |
| 5,235,511 | A | | 8/1993 | Middleton et al. | |
| 5,463,852 | A | | 11/1995 | O'Halloran et al. | |
| 5,682,311 | A | * | 10/1997 | Clark | 701/50 |
| 5,682,312 | A | * | 10/1997 | Rocke | 701/50 |
| 5,752,333 | A | | 5/1998 | Nakagawa et al. | |
| 5,924,439 | A | * | 7/1999 | Miyazoe et al. | 137/269 |
| 6,125,561 | A | | 10/2000 | Shull | |
| 6,181,999 | B1 | | 1/2001 | Yamamoto et al. | |
| 6,317,676 | B1 | | 11/2001 | Gengler et al. | |
| 6,478,516 | B2 | * | 11/2002 | Hatley et al. | 409/132 |
| 6,546,702 | B1 | * | 4/2003 | Pickett | 53/485 |
| 6,697,724 | B2 | * | 2/2004 | Beck | 701/50 |
| 6,845,311 | B1 | * | 1/2005 | Stratton et al. | 701/50 |
| 7,251,935 | B2 | * | 8/2007 | Zhang et al. | 60/461 |
| 7,627,966 | B2 | * | 12/2009 | Koch et al. | 37/348 |
| 7,726,125 | B2 | * | 6/2010 | Brinkman et al. | 60/452 |
| 2008/0183356 | A1 | * | 7/2008 | Kale et al. | 701/50 |
| 2008/0269981 | A1 | * | 10/2008 | Pagnotta et al. | 701/35 |
| 2009/0062804 | A1 | * | 3/2009 | Runquist et al. | 606/80 |

* cited by examiner

OTHER PUBLICATIONS

Kale et al., U.S. Appl. No. 11/700,191, filed Jan. 31, 2007.

*Primary Examiner* — James Trammell
*Assistant Examiner* — McDieunel Marc
(74) *Attorney, Agent, or Firm* — Finnegan, Henderson, Farabow, Garrett & Dunner LLP

(57) ABSTRACT

A control system for a mobile excavation machine is disclosed. The control system may include a ground engaging work tool, a sensor, and a controller. The sensor may be configured to sense a parameter indicative of a current travel speed of the mobile excavation machine and generate a speed signal in response thereto. The controller may be in communication with the ground engaging work tool and the sensor, and configured to receive the signal. The controller may also be configured to determine a cutting depth of the ground engaging work tool into a material and calculate a current productivity value associated with removal of the material based on the speed signal and the determined cutting depth. The controller may be further configured to control the ground engaging work tool to vary the amount of material currently being removed in response to the current productivity value.

20 Claims, 3 Drawing Sheets

AUTOLOAD SYSTEM FOR EXCAVATION BASED ON PRODUCTIVITY

TECHNICAL FIELD

The present disclosure relates generally to an autoload control system and, more particularly, to a system for determining a current productivity value and controlling a machine's excavation in response thereto.

BACKGROUND

Machines such as, for example, wheel tractor scrapers, dozers, motor graders, wheel loaders, and other types of heavy equipment are used to perform a variety of earth-moving tasks. For example, a wheel tractor scraper may be used for excavating, hauling, and dumping an excavated material. A wheel tractor scraper may be used in an operating cycle to cut material from one location during a load phase, transport the cut material to another location during a haul phase, unload the cut material during a dump phase, and return to an excavation site during a return phase to repeat the operating cycle. However, removal of large amounts of material can be difficult for an unskilled or inexperienced operator to achieve efficiently. For example, an unskilled operator may attempt to remove a maximum amount of material during each load phase, but may only be able to do so at a very slow speed. Another unskilled operator may attempt to travel quickly, but may only be able to remove a very small amount of material during each load phase at that speed. Finding the most productive combination of load and travel speed can be complicated, especially when manually performed by an inexperienced operator. Poor productivity and low efficiency can be costly to a machine owner. Because of these factors, the completion of some tasks by a completely operator-controlled machine can be expensive, labor intensive, time consuming, and inefficient.

One method of improving the operation of a machine under such conditions is described in U.S. Pat. No. 6,125,561 (the '561 patent) issued to Shull on Oct. 3, 2000. The '561 patent describes an automatic depth control system of a scraper bowl based on a force error signal between a measured force and a target force. The measured force is derived by a sensor on the scraper bowl. An operator manually inputs the target force value to a computer module depending on a material acting on the scraper bowl. The force signal error, being the difference between the measured force and the target force value, is converted by the computer module to automatically adjust the depth of cut performed by the scraper bowl. Additionally, the scraper bowl can be further controlled by constraining vertical speed to prevent digging too deep or breaking through the ground.

Although the control system of the '561 patent may be capable of improving machine productivity, its use may be limited. Because the automated control of the scraper bowl is based on a predefined target force value associated with the condition of the material acting on the scraper bowl, the cutting depth of the scraper bowl may hinge on the operator's assessment of the material. An operator error may result in inaccurate cutting depth and inefficiency of the task at hand. Also, the machine may encounter terrain of a worksite which varies in condition. An operator may be required to alter the target force value between conditions which may be time consuming, inefficient, and labor intensive. The operator may not be aware of the varying material conditions of the terrain and leave the target force value unchanged. This may result in inaccurate cutting depth of the scraper bowl and an inefficient and unproductive excavation.

The disclosed system is directed to overcoming one or more of the problems set forth above.

SUMMARY OF THE DISCLOSURE

One aspect of the present disclosure is directed to a control system for a mobile excavation machine. The control system may include a ground engaging work tool, a sensor; and a controller. The sensor may be configured to sense a parameter indicative of a current travel speed of the mobile excavation machine and generate a speed signal in response thereto. The controller may be in communication with the ground engaging work tool and the sensor, and configured to receive the signal. The controller may also be configured to determine a cutting depth of the ground engaging work tool into a material and calculate a current productivity value associated with removal of the material based on the speed signal and the determined cutting depth of the ground engaging work tool. The controller may be further configured to control the ground engaging work tool to vary the amount of material currently being removed in response to the current productivity value.

Another aspect of the present disclosure is directed to a method of controlling machine operation. The method may include determining a current machine travel speed and determining a cutting depth of a ground engaging work tool into a material. The method may also include calculating a current productivity value based on the current machine travel speed and the determined cutting depth. The method may further include varying the amount of material currently-being excavated in response to the current productivity value.

DETAILED DESCRIPTION

Figure 1:
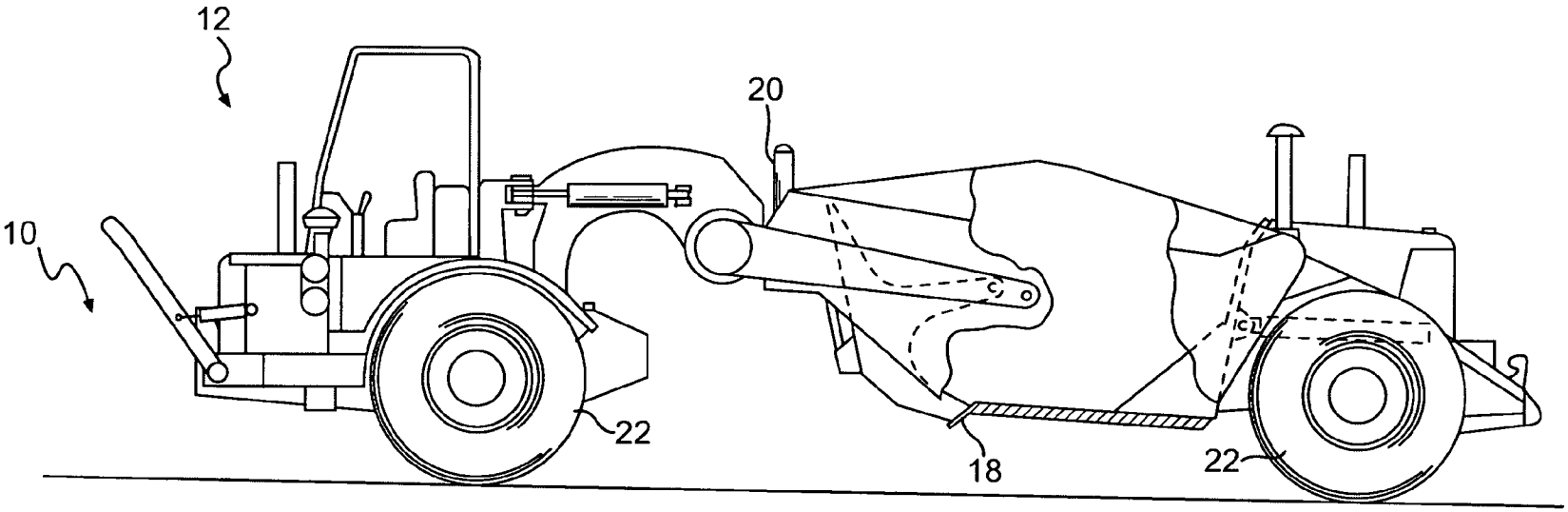
FIG. 1 is a pictorial illustration of an exemplary disclosed machine operating at a worksite.

FIG. 1 illustrates a worksite 10 with an exemplary machine 12, such as a wheel tractor scraper, performing a predetermined task. Worksite 10 may include; for example, a mine site, a landfill, a quarry, a construction site, or any other type of worksite. The predetermined task may be associated with altering the current geography at worksite 10 and may include, for example, a grading operation, a scraping operation, a leveling operation, a bulk material removal operation, or any other type of geography altering operation at worksite 10.

Machine 12 may embody a mobile machine that performs some type of operation associated with an industry such as mining, construction, farming, or any other industry. For example, machine 12 may be an earth moving machine such as a wheel tractor scraper having a blade or other ground engaging work tool 18 movable by way of one or more motors or cylinders 20. Machine 12 may also include one more traction devices 22, which may function to steer and/or propel machine 12.

Figure 2:
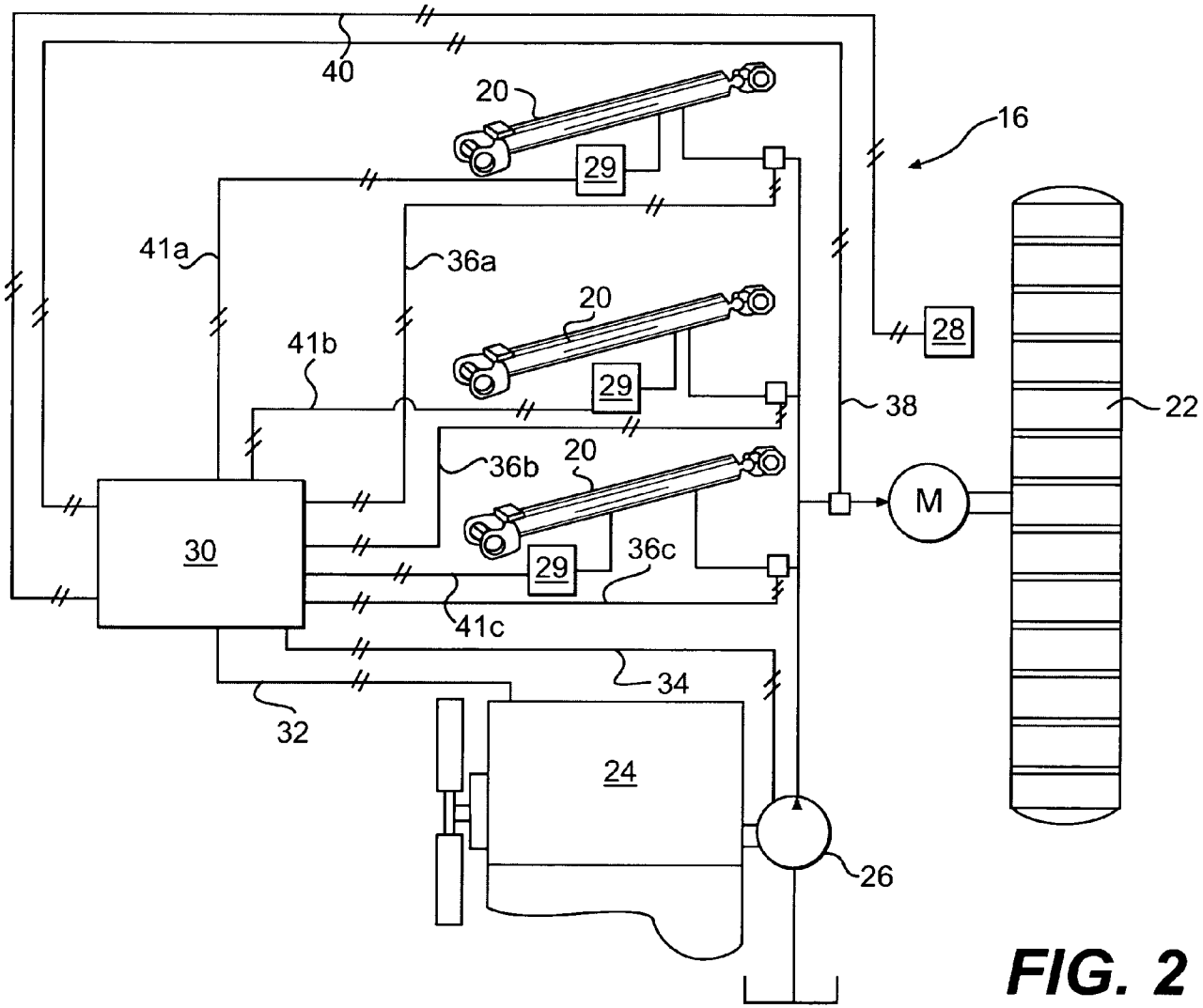
FIG. 2 is a diagrammatic illustration of an exemplary disclosed control system for use with the machine of FIG. 1.

As best illustrated in FIG. 2, machine 12 may include a control system 16 in communication with components of machine 12 to affect the operation of machine 12. In particular, control system 16 may include a power source 24, a means 26 for driving cylinders 20 and traction device 22, a travel speed sensor 28, a position measurement sensor 29, and a controller 30. Controller 30 may be in communication with power source 24, driving means 26, cylinders 20, traction device 22, and travel speed sensor 28 via multiple communication links 32, 34, 36*a-c*, 38, and 40, respectively.

Power source 24 may embody an internal combustion engine such as, for example, a diesel engine, a gasoline engine, a gaseous fuel powered engine, or any other type of engine apparent to one skilled in the art. Power source 24 may alternatively or additionally include a non-combustion source of power such as a fuel cell, a power storage device, an electric motor, or other similar mechanism. Power source 24 may be connected to driving means 26 via a direct mechanical coupling, an electric circuit, or in any other suitable manner.

Driving means 26 may include a pump such as a variable or fixed displacement hydraulic pump drivably connected to power source 24. Driving means 26 may produce a stream of pressurized fluid directed to cylinders 20 and/or to a motor associated with traction device 22 to drive the motion thereof. Alternatively or additionally, driving means 26 could include a generator configured to produce an electrical current used to drive any one or all of cylinders 20 and traction device 22, a mechanical transmission device, or any other appropriate means known in the art.

Speed sensor 28 may be associated with machine 12 to determine a travel speed of machine 12 relative to the work site 10. For example, speed sensor 28 may embody an electronic receiver configured to communicate with one or more satellites (not shown) or a local radio or laser transmitting system to determine a relative location and speed of itself. Speed sensor 28 may receive and analyze high-frequency, low power radio or laser signals from multiple locations to triangulate a relative 3-D position and speed. Speed sensor 28 may also include a ground-sensing radar system to determine the travel speed of machine 12 relative to the work site 10. Alternatively, speed sensor 28 may embody an Inertial Reference Unit (IRU) or a position sensor associated with traction device 22, or any other known locating and speed sensing device operable to receive or determine positional information associated with machine 12. A signal indicative of this position and speed may then be communicated from speed sensor 28 to controller 30 via communication link 40.

Position measurement sensor 29 may be configured to generate a position measurement indicative of a cutting depth of ground engaging work tool 18. In particular, position measurement sensor 29 may measure position data and relay the position data to controller 30 via communication link 41*a*, 41*b*, or 41*c*. Position measurement sensor 29 may embody, for example, a resistance gauge associated with the ground engaging work tool 18 which reacts to a position of a magnet on cylinder 20.

Controller 30 may include means for monitoring, recording, storing, indexing, processing, determining, and/or communicating the location and speed of machine 12, the position measurement on cylinders 20, and the productivity of machine 12 and for automatically controlling operations of machine 12 in response to a maximum productivity. These means may include, for example, a memory, one or more data storage devices, a central processing unit, or any other components that may be used to run the disclosed application. Furthermore, although aspects of the present disclosure may be described generally as being stored in memory, one skilled in the art will appreciate that these aspects can be stored on or read from different types of computer program products or computer-readable media such as computer chips and secondary storage devices, including hard disks, floppy disks, optical media, CD-ROM, or other forms of RAM or ROM.

Controller 30 may determine productivity based on one or more inputs associated with the operational characteristics of machine 12. For example, productivity may be a function of the cutting depth measured by position measurement sensors 29 and speed measured by speed sensor 28. Productivity may be a measure of, for example, the amount of material that machine 12 moves in a given interval of time (i.e., volume per time). Alternatively, productivity may be a measure of forces (i.e., power to the ground) with respect to ground engaging work tool 18 position and speed. It is also contemplated that the productivity may be determined by other methods of calculating or approximating the work performed by machine 12 within a time period.

Controller 30 may record and/or compare data relating to the productivity of machine 12 at different cutting depths. In this way, controller 30 may further determine a change in productivity with respect to the cutting depths of ground engaging work tool 18. To maximize an instantaneous productivity of machine 12, controller 30 may evaluate the time derivative of the productivity and determine a point of maximum productivity. The point of maximum productivity may indicate a cutting depth at which machine 12 may remove the maximum amount of material given the current mechanical and terrain characteristics. Since the data used to determine productivity may be created and stored by controller 30 on the fly and continuously or periodically updated according to various input parameters from speed sensor 28, position measurement sensor 29, and any other available input device, the determination of maximum productivity may not be limited to a single machine 12, a single ground engaging work tool 18 configuration, or a single type of worksite 10. Controller 30 and the associated automated excavation control may be utilized with different types of machine 12, different ground engaging work tool 18 configurations and different worksites 10, each time creating a job-specific productivity map and maximizing instantaneous productivity based on that map.

Controller 30 may control cylinders 20 and/or traction devices 22 to automatically alter the geography of worksite 10. In particular, controller 30 may automatically control operations of machine 12 to engage ground engaging work tool 18 with the terrain of worksite 10. Controller 30 may be in communication with the actuation components of cylinders 20 to raise, lower, or maintain the position of ground engaging work tool 18. Controller 30 may further be in communication with traction device 22 to raise, lower, or maintain the current speed of machine 12. In this manner, controller 30 may provide for partial or full automatic control of machine 12.

Controller 30 may control cylinder 20 to achieve maximum productivity. For example, controller 30 may manipulate a cutting depth of ground engaging work tool 18 to find the optimal operational condition where the rate of change of productivity with respect to time is substantially zero. When the rate of change of productivity is greater than zero, controller 30 may increase the cutting depth of ground engaging work tool 18 and, subsequently decrease speed of machine 12. Controller 30 may decrease the cutting depth of ground engaging work tool 18 and, subsequently increase speed of machine 12, when the rate of change of productivity is less than zero. And when the rate of change of productivity is zero, controller 30 may maintain the cutting depth of ground engaging work tool 18. This results in oscillation of the cutting depth of ground engaging work tool 18 around the optimal operation condition until an operator intervenes and terminates the operation. It is contemplated that controller 30 may alternatively only determine whether the machine 12 is currently operating at a maximum productivity, and then relinquish control of machine 12 to an operator with information regarding the productivity, if desired.

Figure 3:
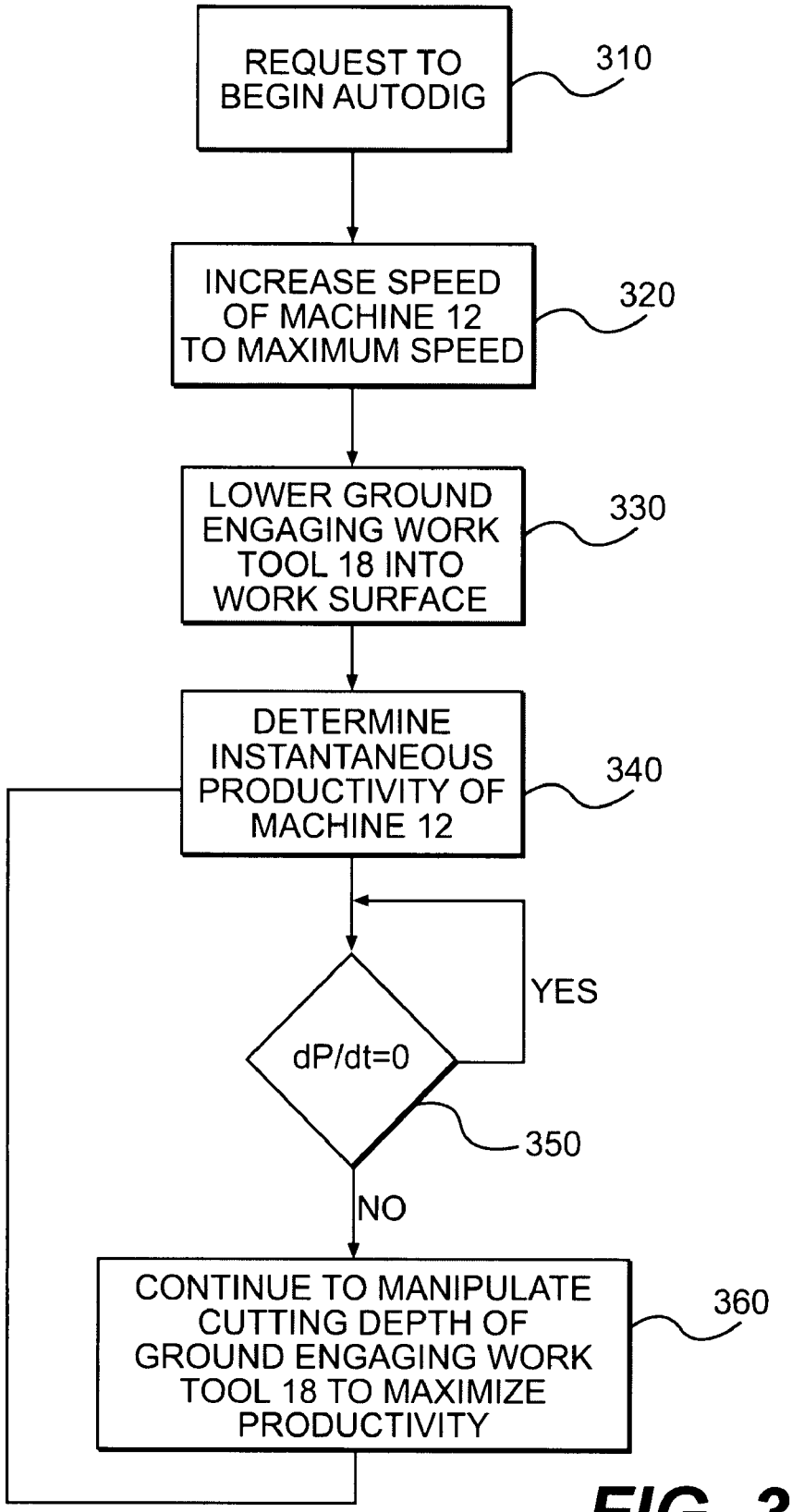
FIG. 3 is a flowchart depicting an exemplary method performed by the control system of FIG. 2.

FIG. 3 is flow chart depicting an exemplary method performed by the control system of FIG. 2. FIG. 3 will be discussed in more detail in the following section to further illustrate the disclosed control system and its operation.

Industrial Applicability

The disclosed control system may be applicable to machines performing material moving operations where productivity is important. In particular, the disclosed control system may determine a machine's current productivity and automatically control an operating condition (such as blade height) to maximize removal of earthen material in a minimum amount of time. Because the control system may only be based on currently determined productivity, the control system may be applicable to nearly any machine 12 in any condition with any configuration of ground engaging work tool 18 operating at any worksite 10. The operation of control system 16 will now be described.

FIG. 3 illustrates the operation of control system 16. Controller 30 may receive a request to begin an automatic digging (autodig) function (step 310). This request may be made by the operator currently in control of the machine. The request may be made via a single switch (not shown). It is contemplated that the single switch may trigger a series of machine 12 events simultaneously or in a predetermined sequence. For example, operator manipulation of the single switch may begin an autodig function, which will be described in detail below. Further, the single switch may be programmed to allow controller 30 to automate complicated sequences of machine 12 events, such as downshifting, upshifting, or changing machine direction while simultaneously lowering or raising ground engaging work tool 18. It is also contemplated that the request to begin an autodig function may be initiated using any other method known in the art for communicating a request to controller 30.

Upon receiving a request to initiate the autodig function, controller 30 may increase the speed of machine 12 to a maximum speed (step 320). The maximum speed may be a limit of the machine 12 or may, alternatively, be a limit set by an operator. Controller 30 may increase machine travel speed by regulating the output of driving means 26 and/or power source 24. Once this maximum speed is attained, controller 30 may lower ground engaging work tool 18 of machine 12 into the work surface (step 330). Ground engaging work tool 18 may be moved by regulating, for example, a pressure of fluid supplied to cylinders 20. Once ground engaging work tool 18 engages worksite 10, the maximum speed of machine 12 will begin to decrease as a result of the increasing load on cylinders 20 and machine 12. In fact, there may exist a point at which machine 12 stops (i.e., completely stalls) due to an excessive load. Similarly, as ground engaging work tool 18 is retracted from worksite 10, machine 12 may increase speed due to a decreasing load on cylinders 20. As the ground engaging work tool 18 is completely retracted and blade depth is zero, machine 12 may return to the maximum speed attained before ground engaging work tool 18 engaged worksite 10. At a point between the maximum ground speed and the stalled condition, the ground engaging work tool 18 may attain a maximum productivity depth. This depth may indicate a situation where the greatest amount of material is being removed in the least amount of time. From this ground engaging work tool 18 depth, an increase or decrease in depth may result in less productivity. Further, the maximum productivity depth of ground engaging work tool 18 may be unique to machine 12, the configuration and condition of ground engaging work tool 18, and current worksite 10 conditions.

As machine 12 is maintaining a positive speed and position measurement sensors 29 detect a position of the ground engaging work tool 18 of machine 12, controller 30 may continuously monitor one or more inputs from speed sensor 28 and position measurement sensor 29 to determine an instantaneous productivity of machine 10 with respect to the current speed of machine 10 and a cutting depth of ground engaging work tool 18 (step 340). If controller 30 determines that the current rate of change of productivity with respect to time is nonzero (i.e. increasing or decreasing) (step 350; no), then controller 30 may continue to manipulate cutting depth and, subsequently the machine speed, to maximize productivity (step 360) while continuously determining the rate of change of productivity of machine 12 (step 340). For example, when the current rate of change of productivity is greater than zero, controller 30 may be configured to increase the cutting depth of ground engaging work tool 18. Likewise, if the current rate of change of productivity is less than zero, controller 30 may be configured to decrease the cutting depth of ground engaging work tool 18.

When controller 30 determines that the current rate of change of productivity with respect to time is zero (i.e., machine 12 has reached a maximum attainable productivity and any change in tool depth results in less productivity) (step 350; yes), then controller 30 may maintain the current depth of ground engaging work tool 18, while continuously monitoring the rate of change of productivity (step 340). Once controller 30 determines that the rate of change of productivity with respect to time is no longer zero (step 350; no) (i.e., no longer at a maximum productivity), then controller 30 once again may be configured to manipulate the cutting depth of ground engaging work tool 18 and, indirectly, machine speed (step 360), while continuing to monitor the rate of change of productivity (step 340).

Because controller 30 automatically varies the cutting depth of ground engaging work tool 18 of machine 12 based on instantaneous productivity, it's accuracy may be substantially unaffected by a change in condition or geography of worksite 10. Controller 30 may automatically manipulate ground engaging work tool 18 to a cutting depth without a predetermined assessment and input of worksite 10 by an operator. Inefficiency, time consumption, excess labor, and operator error may be avoided as controller 30 automatically controls an excavation of machine 12 and improves productivity.

It will be apparent to those skilled in the art that various modifications and variations can be made to the disclosed control system. Other embodiments will be apparent to those skilled in the art from consideration of the specification and practice of the disclosed control system. It is intended that the specification and examples be considered as exemplary only, with a true scope being indicated by the following claims.

What is claimed is:

1. A control system for a mobile excavation machine, comprising:

a ground engaging work tool;

a sensor configured to sense a parameter indicative of a current travel speed of the mobile excavation machine and to generate a speed signal in response thereto; and a controller in communication with the ground engaging work tool and the sensor, the controller being configured to:

receive the signal;

determine a value indicative of the cutting depth of the ground engaging work tool into a material;

calculate a current productivity value associated with removal of the material based on the speed signal and the determined value indicative of the cutting depth of the ground engaging work tool; and control the ground engaging work tool to vary the amount of material currently being removed in response to the current productivity value.

2. The control system of claim 1, further including a position measurement sensor configured to generate a position measurement signal indicative of the cutting depth of the ground engaging work tool, wherein the controller is configured to determine the value indicative of the cutting depth based on the position measurement signal.

3. The control system of claim 2, wherein the position measurement sensor includes a resistance gauge associated with the ground engaging work tool.

4. The control system of claim 1, wherein the controller is further configured to determine a rate of change of the current productivity value with respect to time.

5. The control system of claim 4, wherein the controller is configured to control the ground engaging work tool to vary the amount of material removed when the rate of change is a value different than a desired rate of change.

6. The control system of claim 5, wherein the desired rate of change is zero.

7. The control system of claim 5, wherein the controller is configured to vary the amount of material removed by automatically changing the cutting depth of the ground engaging work tool to a depth that results in the desired rate of change.

8. The controller of claim 7, wherein the controller is configured to increase the cutting depth when the rate of change of the current productivity is greater than the desired rate of change.

9. The control system of claim 7, wherein the controller is configured to decrease the cutting depth when the rate of change of the current productivity is less than the desired rate of change.

10. The control system of claim 7, wherein the controller is configured to maintain the cutting depth when the rate of change of the current productivity is the desired rate of change.

11. The control system of claim 7, wherein the controller is configured to vary the cutting depth until an operator intervenes.

12. A method of controlling machine operation, comprising:

determining by a processor device a current machine travel speed;

determining by the processor device a value indicative of a cutting depth of a ground engaging work tool into a material;

calculating by the processor device a current productivity value based on the current travel speed and the value indicative of the cutting depth; and varying the amount of material currently being excavated in response to the current productivity value.

13. The method of claim 12, further including:

determining a value indicative of a rate of change of the current productivity value with respect to time; and initiating excavation in response to the value.

14. The method of claim 13, including varying the amount of material currently being excavated by changing a depth of excavation.

15. The method of claim 14, including automatically varying the depth of excavation responsive to the value of the rate of change.

16. The method of claim 15, including varying the depth of excavation to a depth that results in a desired value of the rate of change, wherein the desired value is zero and maintaining the depth of excavation when the rate of change is the desired value.

17. The method of claim 16, including increasing the depth of excavation when the rate of change exceeds the desired value and decreasing the depth of excavation when the rate of change falls below the desired value.

18. The method of claim 16, including varying the depth of excavation until an operator intervenes.

19. A mobile excavation machine, comprising:

a power source configured to generate a power output;

a traction device configured to receive the power output and propel the mobile excavation machine;

a ground engaging work tool driven by the power source to move into and out of a work surface;

a sensor configured to sense a parameter indicative of a travel speed of the mobile excavation machine and to generate a signal in response thereto;

a position measurement sensor configured to sense a parameter indicative of a cutting depth of the ground engaging work tool; and a controller in communication with the ground engaging work tool, the speed sensor, and the position measurement sensor, the controller being configured to:

calculate a current productivity value associated with removal of the material based on the speed signal and the position measurement signal; and control the ground engaging work tool to vary the amount of material currently being removed in response to the current productivity value.

20. The mobile excavation machine of claim 19, wherein the controller is further configured to:

determine a value indicative of a rate of change of the current productivity value with respect to time;

vary the cutting depth of the ground engaging work tool until the value of the rate of change is a desired value of zero; and maintain the cutting depth of the ground engaging work tool when the value of the rate of change is the desired value.

* * * * *